United States Patent [19]

Kokeisl

[11] 4,173,811

[45] Nov. 13, 1979

[54] SKI-TIE DEVICE

[76] Inventor: Theodor Kokeisl, Zurlindenstrasse 21, 5000 Aarau, Switzerland

[21] Appl. No.: 865,301

[22] Filed: Dec. 28, 1977

[30] Foreign Application Priority Data

Dec. 29, 1976 [CH] Switzerland ..... 16428/76

[51] Int. Cl.[2] ..... A44B 21/00; A63C 11/02

[52] U.S. Cl. ..... 24/73 SG; 24/73 VA; 280/11.37 A

[58] Field of Search ..... 24/73 SG, 73 VA, 81 SK, 24/16 R, 16 PB, 17 R, 17 A, 73 PB; 280/11.37 A, 11.37C, 11.37 E, 11.37 K; 224/45 S, 5 Z; 248/74 PB

[56] References Cited

U.S. PATENT DOCUMENTS

| | | | |
|---|---|---|---|
| 3,951,421 | 4/1976 | Brangenberg | 280/11.37 E |
| 4,047,726 | 9/1977 | Kokeisl | 24/73 SG |

FOREIGN PATENT DOCUMENTS

| | | | |
|---|---|---|---|
| 1499959 | 4/1966 | France | 280/11.37 A |
| 405131 | 7/1966 | Switzerland | 24/73 SG |

*Primary Examiner*—Kenneth J. Dorner
*Attorney, Agent, or Firm*—Karl F. Ross

[57] ABSTRACT

A ski-tie device comprises a flat housing from which an elastic band can be withdrawn laterally to engage a similar device on another ski of the pair. Integral with the elastic band is a pair of resilient strips anchored in the housing and the band is provided with an abutment engageable with an abutment of the housing to prevent excessive stretching of these strips when the band is withdrawn from the housing and stretched.

8 Claims, 11 Drawing Figures

SKI-TIE DEVICE

FIELD OF THE INVENTION

The present invention relates to a device for the pair-wise tying of skis with elastic members and, more particularly, to a device mounted upon the upper surface of a ski which can be used to connect the skis together with their running surfaces facing one another, e.g., for storage and transport.

BACKGROUND OF THE INVENTION

To facilitate the carrying and storage of skis, it is a common practice to provide an elastic member by which the skis of a pair are tied together with their running surfaces juxtaposed or in contact with one another. In its simplest form such a device can be a strip whose ends can be interconnected and which can be passed completely around a pair of skis so positioned.

Because such ties may be lost, it is known to provide the skis with members performing the same function, i.e., the interconnection of the skis of each pair.

For example, a housing may be provided upon the upper surface of each ski from which an elastic band can be withdrawn and resiliently extended so as to pass around the edges of a pair of skis and hook onto the housing of a similar device of the other ski. When two such elastic bands are used in this manner, the ski is securely held by the elastic force of the bands, each band of one device being hooked onto the other device after passing around respective edges of the next.

In the relaxed condition of each band, the intrinsic elasticity retracts the band practically completely within the respective housing in which one end of the band is anchored, the housing having an opening through which the free end of the band can be grasped to withdraw the band and pass this free end around the respective edges of the ski.

The free end of the band can be formed with a grip to facilitate engagement by the hand of the user and in a retracted position, this grip and the respective eye, which is engageable by hook action with the other device, lies practically within the outline of the housing and does not extend beyond the edge of the ski to interfere with the skiing operation.

While such devices have been found to be highly desirable and indeed advantageous for the purposes described, the conventional units of this type exert excessive stretch upon the band in the fully extended position thereof and thus require larger bands and hence a device whose overall dimensions may be greater than is desired. Furthermore, excessive stress may be placed at the points at which the retained end of the band is anchored to the housing.

OBJECT OF THE INVENTION

It is the object of the present invention to provide an improved device for the pair-wise interconnection of skis.

SUMMARY OF THE INVENTION

This object and others which will become apparent hereinafter are attained, in accordance with the present invention, in a device of the aforedescribed type having a flat housing extending transversely of the ski and connected to the upper surface thereof, an elastic band having a free end provided with a hand grip and an eye, the eye being engageable with a similar device on the other ski of the pair, and a window in the housing through which the band can be withdrawn so as to stretch around edges of the pair of skis. According to the invention, the inner end of the band is provided with a restoring spring connected to the end of the housing remote from the window and with an abutment engageable with a ridge or abutment of the housing adjacent this window, the interengaging abutments retaining the inner end of the band within the housing as the band is stretched to pass around the edge of the ski. The restoring spring, when the band is released, draws the inner end of the band away from the abutment and hence retracts the relaxed band into the housing through the opening. The abutment is thus spaced from the anchorages of the restoring spring in the direction in which the band is displaced to tie the skis together.

According to a feature of the invention, this restoring spring is dimensioned with a force constant which is substantially less than the force constant of the band itself, i.e., of the band between the abutment and the eye, so that for a given force applied to the restoring spring between the anchorage and the abutment of the band, the stretch of the restoring spring will be a multiple of the stretch of the band between its abutment and the eye.

In other words, the restoring spring, which does not receive the full stress upon elongation of the band because of the interposition of the abutments, can be relatively soft and nevertheless have sufficient spring force to retract the relaxed band into the housing. The band can be withdrawn from the housing up to the point of engagement of the abutments practically stretch-free and without stress. This arrangement has been found to permit a construction in which the holder or housing and the band are relatively small so that the device is particularly suitable for use with narrow-width skis as are common in cross-country skiing.

It has also been found to be advantageous to form the restoring spring unitarily, i.e., in one piece, with the band, e.g., in the form of a pair of strips of the elastomeric material or rubber of this band. The strips, in a fully relaxed and unstretched position of the band and the strips, being transverse or substantially transverse to the longitudinal dimension of the band and the direction in which it is withdrawn from the housing. This further reduces the size of the device of the present invention by comparison with earlier systems.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
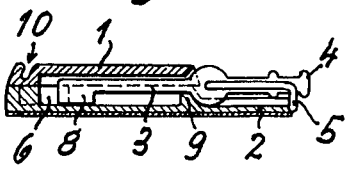
FIG. 1 is a vertical longitudinal cross-section through a device in accordance with the present invention showing the band fully retracted into the housing, the cross-sectional view being taken perpendicular to the upper surface of the ski upon which the device can be mounted and in a plane perpendicular to the longitudinal dimension of the ski.

The device shown in the drawing comprises a flat housing which is streamlined in the skiing direction and has a base 2 which is affixed to the upper surface of the ski to extend transversely thereof from one longitudinal edge of the ski to the other. The base 2 is closed by a cover 1 which is fastened, in turn, to the base 2 and defined therewith a flattened chamber in which the greater part of the length of an elastic band 3 can be received.

The band 3 consists of rubber and is formed at its free end, extending out of the aforementioned chamber, with a grip 4 carrying a wire eye 5.

Figure 3:
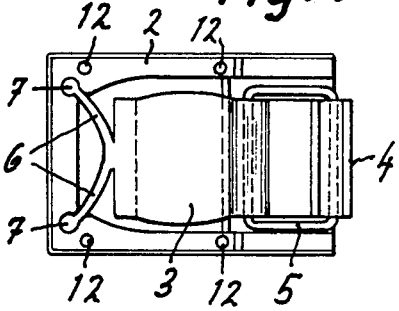
FIG. 3 is a plan view of the device of FIG. 1 with the upper cover of the housing removed.
Figure 4:
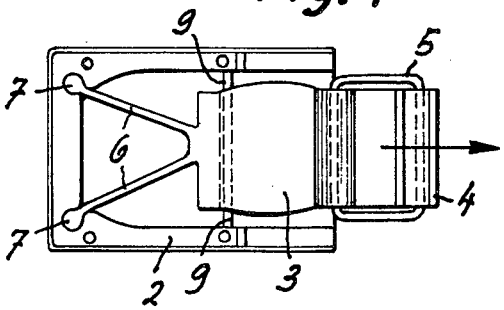
FIG. 4 is a plan view of the device in the position of FIG. 2, also with the upper housing cover removed.
Figure 10:
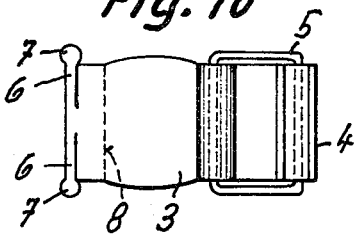
FIG. 10 is a plan view of the elastic band.

As is especially apparent from FIGS. 3, 4 and 10, the inner end of the band 3 is formed in one piece with a pair of elastic ligatures or strips 6 which terminate in bulges 7 received in corresponding recesses formed in the housing 1, 2 remote from the window through which the band is withdrawn. The bulges 7 are form-fittingly received in these recesses.

The strips 6 serve as restoring springs for the band 3. They are so constructed and arranged that their longitudinal axes, in a relaxed condition (FIG. 10), lie transversely to the longitudinal axis and the direction of withdrawal of the elastic band 3.

At its rear or inner end, the band 3 is formed, also unitarily, along its underside with a rib 8 forming an abutment. The base 2 of the housing 1, 2, at a location spaced from the anchorages 7 of the springs 6, is provided with a ridge 9 forming an abutment engageable by the rib 8 as the band 3 is drawn from the housing in the direction of the arrow (FIG. 4).

Figure 2:
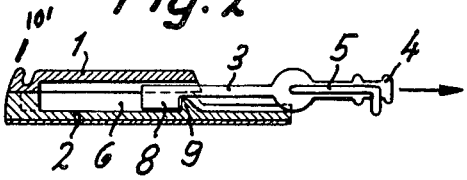
FIG. 2 is a section similar to FIG. 1 showing the initial movement of the band until its abutment engages the housing abutment and before any significant stretch is applied to the band.
Figure 5:
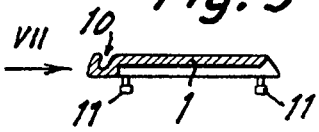
FIG. 5 is a vertical section through the housing cover.
Figure 9:
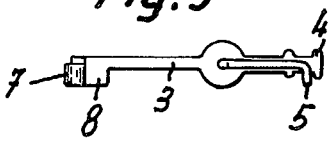
FIG. 9 is a side-elevational view of the elastic band of the device.
Figure 6:
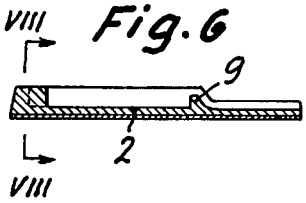
FIG. 6 is a vertical section through the base of the housing.

As can be seen from FIGS. 1, 2 and 5, the housing cover 1 is provided with a groove 10 defined in part by an upstanding formation 10′ constituting a hook in which the eye 5 is engageable.

Figure 7:
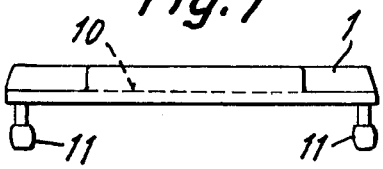
FIG. 7 is a view taken in the direction of arrow VII (end view) in FIG. 5, drawn to an enlarged scale.
Figure 8:
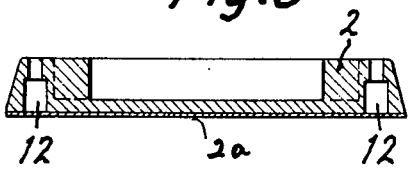
FIG. 8 is a section taken along the line VIII—VIII of FIG. 6, also drawn to an enlarged scale.

The attachment of the cover 1 to the base 2 of the housing is effected by press-fitted studs 11 (FIG. 7) which snap into stepped bores 12 of this base (FIG. 8). The base 2 is provided on its underside with a pressure adhesive layer 2*a* by which the device can be attached to the upper surface of the ski upon the removal of a masking sheet.

On the upper surface of each ski of the pair, it is customary to provide a respective one of these devices at the same distance from the respective bindings or toes of the skis. However, when a more secure attachment of the two skis together is desired, two such devices can be mounted on the upper surface of each ski of the pair, preferably equidistant from the tip and heel of the ski. The windows through which the bands are withdrawn are all oriented to the same side, e.g., to the right or to the left.

Figure 11:
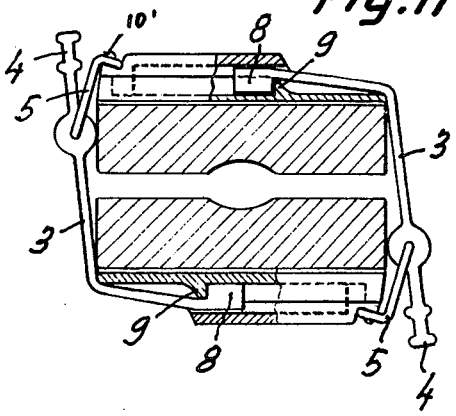
FIG. 11 is a transverse section, partly broken away, through a pair of skis held together by two such devices according to the invention.

Thus, when the skis of each pair are placed face to face, with their running surfaces in juxtaposition, corresponding tie devices are disposed at the same level and, as shown in FIG. 11, the band 3 of one device, e.g., the upper in FIG. 11, can have its eye 5 hooked into the recess 10 of the other device (lower in FIG. 11). Correspondingly, the lower device can have its band 3 extended around the left side and its eye 5 hooked into the recess 10 of the upper device.

In other words, for the storage or transport of the skis or to facilitate carrying them, each band of each device has its eye hooked into the diagonally opposite recess 10, the band 3 being drawn out by the grip 4 from the respective housing. The strips 6 are highly stretchable and yield readily (FIG. 4) until the abutment 8 engages the abutment 9 of the housing. Continued traction upon the grip thereupon stretches the band around the side of the pair of skis and exerts a force in the opposite direction which holds the pair of skis together.

I claim:

1. A device for tying a pair of skis together, comprising:

a substantially flat housing adapted to be mounted on an upper surface of a ski and to extend transversely thereof, said housing defining a compartment having a window opening at one side of the housing;

an elongated elastic band having an inner end resiliently connected to said housing within said compartment at a location remote from said window and a free end provided with a grip engageable by a user to draw said band through said window, said free end being provided with means engageable with another such housing on another ski whereby said band holds a pair of skis together;

at least one elastic member anchored to said housing at said location and connected to said inner end of said band for resiliently connecting same to said housing; and an abutment formed on said housing adjacent said window and engageable with a formation on said inner end of said band upon withdrawal of said band through said opening to anchor said inner end of said band within said housing, said inner end of said band being elastically drawn away from said abutment by said member in a relaxed condition of said band, said elastic member having a lesser force constant than the portion of said band between said ends.

2. The device defined in claim 1 wherein said inner end is formed with a rib constituting said formation and extending transversely of the direction in which said band is withdrawn and engageable with said abutment.

3. The device defined in claim 2 wherein said member is formed unitarily with said band from an elastomeric material.

4. The device defined in claim 3 wherein said member is one of a pair of strips lying transversely of said band in a relaxed condition thereof.

5. The device defined in claim 4 wherein each of said strips is formed with a respective bulge form-fittingly received in a respective recess of said housing to anchor said strips at said location.

6. The device defined in claim 5 wherein said housing is formed with a base provided with a ridge defining said abutment adjacent said opening, and a cover snap-fittingly engaging said base.

7. The device defined in claim 6, further comprising an adhesive layer bonded to said base for securing said base to the upper surface of a ski, said cover being provided with a hook for engagement with an eye provided on the free end of the band of a corresponding device of another ski.

8. The device defined in claim 7 wherein said band is composed of rubber.

* * * * *